US006046578A

United States Patent [19]

Feldtkeller

[11] Patent Number: 6,046,578

[45] Date of Patent: Apr. 4, 2000

[54] CIRCUIT FOR PRODUCING A REFERENCE VOLTAGE

[75] Inventor: Martin Feldtkeller, München, Germany

[73] Assignee: Siemens Aktiengesellschaft, Munich, Germany

[21] Appl. No.: 09/299,363

[22] Filed: Apr. 26, 1999

[30] Foreign Application Priority Data

Apr. 24, 1998 [DE] Germany ..... 198 18 464

[51] Int. Cl.[7] ..... G05F 3/16

[52] U.S. Cl. ..... 323/314; 323/315

[58] Field of Search ..... 323/313, 314, 323/315, 907; 327/538, 539, 540

[56] References Cited

U.S. PATENT DOCUMENTS

| | | | |
|---|---|---|---|
| 4,733,160 | 3/1988 | Draxelmayr | 323/314 |
| 5,670,868 | 9/1997 | Moriguchi et al. | 323/315 |
| 5,841,270 | 11/1998 | Do et al. | 323/314 |
| 5,929,616 | 7/1999 | Perraud et al. | 323/314 |

FOREIGN PATENT DOCUMENTS

| | | | |
|---|---|---|---|
| 0 676 856 A2 | 10/1995 | European Pat. Off. . | |
| 31 19 048 A1 | 3/1982 | Germany . | |
| 59-27326 | 2/1984 | Japan | 323/314 |

OTHER PUBLICATIONS

International Patent Application WO 93/09597, dated May 13, 1993.

*Primary Examiner*—Matthew Nguyen
*Attorney, Agent, or Firm*—Herbert L. Lerner; Laurence A. Greenberg; Werner H. Stemer

[57] ABSTRACT

A circuit for producing a reference voltage produces the reference voltage by adding a number of forward voltages across corresponding pn junctions through which current flows, and a difference formed by two intermediate circuit voltages and multiplied by a corresponding factor. The two intermediate-circuit voltages correspond to summed voltages formed by a number of forward voltages across pn junctions which have different current densities flowing through them. In addition, the use of a corresponding compensation device makes it possible to compensate for a persistent parabolic temperature dependency of the resultant reference voltage.

19 Claims, 3 Drawing Sheets

CIRCUIT FOR PRODUCING A REFERENCE VOLTAGE

BACKGROUND OF THE INVENTION

FIELD OF THE INVENTION

The present invention relates to a circuit for producing a reference voltage or to a reference-voltage source, including a first circuit device for producing a first voltage having a negative temperature coefficient, and a second circuit device for producing a difference voltage from a second voltage and a third voltage, the second voltage and the third voltage are each derived from forward voltages across corresponding pn junctions, the difference voltage is subject to a positive temperature coefficient, and the reference voltage may be tapped off as a sum of the first voltage from the first circuit device and the difference voltage from the second circuit device.

Most integrated circuits operated from an unstabilized supply voltage, that is to say virtually all smart power ICs, require an internal reference voltage source. That is particularly true of voltage regulators having an output voltage which is used by other integrated circuits or circuit blocks as a reference voltage.

Known reference voltage sources use zener diodes, for example, which are supplied with an unstabilized input voltage through a series resistor. A voltage tapped off the zener diode is used as a stabilized reference voltage. In addition, it is possible, in principle, for the forward voltage across a diode or the base/emitter voltage of a bipolar transistor to be used generally as a reference voltage. However, the forward voltage across a pn junction has a negative temperature coefficient and therefore a temperature dependency which has a negative effect for a large number of applications. If, for example, a voltage regulator having an output voltage which is used as a reference voltage is intended to be used to supply sensors, A/D converters or similar components, the output voltage of the voltage regulator must be very precise and, in a particular, extremely temperature-stable. In that context, tolerance limits of up to a maximum of 1% are normal requirements today.

For that reason, the reference voltage sources described above have in recent years been superseded by bandgap reference voltage sources, which provide a temperature-stabilized reference voltage. Those known bandgap reference voltage sources are based on addition of a forward voltage across a pn junction through which current flows and a difference voltage which is multiplied by a corresponding factor and is formed from two forward voltages across two pn junctions that have different current densities flowing through them. In general, the forward voltage across a pn junction with current flowing through it, as already explained above, has a negative temperature coefficient. In contrast, the difference between the two forward voltages rises in proportion to the absolute temperature and is therefore subject to a positive temperature coefficient. If the factor by which the difference voltage explained above is multiplied is set in such a way that the negative temperature coefficient of the forward voltage across the pn junction cancels out the positive temperature coefficient of the difference voltage, it is possible to achieve a temperature-stabilized output or reference voltage which is then a parabolic or square function of temperature. In particular, the output voltage of the bandgap reference voltage source, which is obtained by adding the forward voltage (explained above) across a pn junction through which current flows to the difference voltage, multiplied by the corresponding factor, formed by two further forward voltages, is approximately 1.25 V, which is roughly equivalent to the bandgap of silicon. The magnitude of the output voltage of that reference voltage source has therefore lent its name to the bandgap reference voltage source.

A generalized circuit diagram of a known bandgap reference voltage source is shown in FIG. 2 and described in detail below. In that device, resistor ratios, a current-mirror transmission ratio and a ratio of emitter areas of transistors are particularly critical for achieving a tight tolerance for an output voltage. That circuit also reacts very sensitively to temperature gradients widely encountered in integrated power circuits. Accordingly, it is necessary to configure the transistors in an implemented circuit layout exactly on isotherms from the greatest heat source in the appropriate circuit. However, a modern layout with reusable circuit and layout blocks prevents the circuit from being adapted to suit the particular position of the available heat sources. Furthermore, the number of heat sources in smart power ICs is constantly increasing, so that the course of the corresponding isotherms from those heat sources cannot be determined clearly. The multiplicity of components having pairing properties which are critical in the bandgap reference voltage source also generally necessitates individual adjustment of the circuit. That can be carried out, for example, by using so-called "zapping" zener diodes, that break down and produce a low-resistance connection when a high external voltage is applied in the reverse direction. However, that increases the technical complexity.

SUMMARY OF THE INVENTION

It is accordingly an object of the invention to provide a circuit for producing a reference voltage, which overcomes the hereinafore-mentioned disadvantages of the heretofore-known devices of this general type and which is less sensitive to temperature fluctuations and component tolerances.

With the foregoing and other objects in view there is provided, in accordance with the invention, a circuit for producing a reference voltage, comprising a first circuit device for producing a first voltage having a negative temperature coefficient; a second circuit device for producing a difference voltage from a second voltage and a third voltage; the second voltage and the third voltage each derived from forward voltages across corresponding pn junctions and the difference voltage subject to a positive temperature coefficient; the first voltage from the first circuit device and the difference voltage from the second circuit device added together to form a reference voltage to be tapped off; the first circuit device deriving the first voltage from a summed voltage formed by at least two forward voltages across corresponding pn junctions; and the second circuit device deriving the second voltage and the third voltage from respective first and second summed voltages each formed by at least two forward voltages across corresponding pn junctions, and the second circuit device producing the difference voltage from the second and third voltages.

In accordance with another feature of the invention, the second circuit device derives the second voltage and the third voltage from respective first and second summed voltages each formed by at least two forward voltages across corresponding pn junctions having different current densities flowing through them.

In accordance with a further feature of the invention, the second circuit device includes first, second, third, and fourth bipolar transistors having respective first, second, third and fourth current densities flowing through them, the is second voltage is derived from the summed voltage formed by the forward voltages across the first and the third bipolar transistors, and the third voltage is derived from the summed voltage formed by the forward voltages across the second and the fourth bipolar transistors, the first and the third bipolar transistors have a higher current density flowing through them than the second and the fourth bipolar transistors, and the first and the third bipolar transistors are both constituent parts of the first circuit device deriving the first voltage from the summed voltage formed by the forward voltages across the first and the third bipolar transistors.

In accordance with an added feature of the invention, the first, second, third, and fourth bipolar transistors have emitter areas, the emitter area of the second bipolar transistor is equivalent to a multiple of the emitter area of the first bipolar transistor, and the emitter area of the fourth bipolar transistor is equivalent to a multiple of the emitter area of the third bipolar transistor.

In accordance with an additional feature of the invention, there are provided first, second, third, and fourth resistors; the first, second, third, and fourth bipolar transistors having collectors, bases and emitters; the collector of the first bipolar transistor supplied with a first current, the collector of the second bipolar transistor supplied with a second current, the collector of the third bipolar transistor supplied with a third current and the collector of the fourth bipolar transistor supplied with a fourth current; the base of the first bipolar transistor connected to the emitter of the third bipolar transistor with a first node therebetween, and the emitter of the first bipolar transistor connected through the first resistor to a negative supply voltage connection and through the second resistor to the emitter of the second bipolar transistor; the base of the second bipolar transistor connected to the emitter of the fourth bipolar transistor with a second node therebetween, the first node connected through the third resistor to the negative supply voltage connection and through the fourth resistor to the second node; and the base of the third bipolar transistor connected to the base of the fourth bipolar transistor, causing a summed voltage including base/emitter voltages of the third bipolar transistor and of the first bipolar transistor to correspond to the first voltage, causing a voltage drop across the first resistor to correspond to the difference voltage, and permitting the reference voltage to be tapped off at the base of the third bipolar transistor.

In accordance with yet another feature of the invention, the emitter area of the second bipolar transistor is approximately four times as large as the emitter area of the first bipolar transistor, the emitter area of the fourth bipolar transistor is approximately four times as large as the emitter area of the third bipolar transistor, the first current supplied to the first bipolar transistor is approximately the same size as the second current supplied to the second bipolar transistor, and the first resistor is approximately four times as large as the second resistor.

In accordance with yet a further feature of the invention, the third and the fourth currents respectively supplied to the third and the fourth bipolar transistors and the third and the fourth resistors together cause an emitter current in the fourth bipolar transistor to be markedly smaller than an emitter current in the third bipolar transistor.

In accordance with yet an added feature of the invention, there is provided a current-mirror circuit connected to a positive supply voltage connection and providing the first current supplied to the first bipolar transistor and the second current supplied to the second bipolar transistor.

In accordance with yet an additional feature of the invention, the current-mirror circuit is one current-mirror circuit, a fifth bipolar transistor is connected between the one current-mirror circuit and the collector of the first bipolar transistor, the fifth bipolar transistor has a base, and another current-mirror circuit is connected between the base of the fifth bipolar transistor and the second node. In accordance with again another feature of the invention, there is provided a sixth bipolar transistor with a short-circuited base/collector path, the sixth bipolar transistor connected between the one current-mirror circuit and the collector of the second bipolar transistor. In accordance with again a further feature of the invention, the fifth and sixth bipolar transistors have emitter areas, the emitter area of the sixth bipolar transistor is approximately equivalent to the emitter area of the first bipolar transistor, the emitter area of the fifth bipolar transistor is approximately equivalent to the emitter area of the second bipolar transistor, and the one current-mirror circuit has a translation ratio of 1:1.

In accordance with again an added feature of the invention, there is provided a further current-mirror circuit connected to a positive supply voltage connection and providing the third current supplied to the third bipolar transistor and the fourth current supplied to the fourth bipolar transistor, and an amplifier circuit connected between the further current-mirror circuit and the collectors of the respective third and the fourth bipolar transistors.

In accordance with again an additional feature of the invention, there is provided a third circuit device for compensating for a parabolic temperature dependency of the reference voltage produced by the second circuit device. In accordance with still another feature of the invention, the third circuit device includes a diode connected between the third resistor and the negative supply voltage connection. In accordance with still a further feature of the invention, the third circuit device includes a parallel circuit connected between the third resistor and the negative supply voltage connection, the parallel circuit including a series circuit having another resistor and the diode and a series circuit having two further resistors with a node therebetween; and a further bipolar transistor having a main current path connected in parallel with the two further resistors and a base connected to the node between the two further resistors.

In accordance with still an added feature of the invention, the first circuit device includes an amplifier device for amplifying the reference voltage. In accordance with still an additional feature of the invention, the amplifier device include a voltage divider acting on the base of the third bipolar transistor.

In accordance with yet another feature of the invention, the first and the second circuit devices cause the reference voltage produced as the sum of the first voltage from the first circuit device and the difference voltage from the second circuit device to be approximately 2.5 V.

In accordance with a concomitant feature of the invention, there is provided a control device for maintaining constancy of the reference voltage output to an output connection by the circuit for producing a reference voltage, when the output voltage connection is unevenly loaded.

The advantageous and preferred embodiments of the present invention described above, for their part, help to create a circuit which is as simple to produce as possible, and a temperature stability which is as high as possible.

According to the present invention, the reference voltage is still produced by adding a voltage component with a negative temperature coefficient to a voltage component with a positive temperature coefficient. However, according to the invention, the component having the negative temperature coefficient includes a number of forward voltages across corresponding pn junctions, and the component with the positive temperature coefficient again includes a difference voltage, with each voltage contributing to the difference voltage corresponding to a summed voltage including a number of forward voltages across corresponding pn junctions. In particular, the difference voltage used, which represents the proportion of the desired reference voltage with a positive temperature coefficient, is the difference between two sums including a number of forward voltages across pn junctions with different current densities flowing through them. In this case, the reference voltage source provides an output voltage which is a multiple of the customary bandgap reference voltage. This voltage is sufficiently high for most applications, so that a voltage divider for multiplying the reference voltage can be dispensed with, for example.

Appropriately dimensioning the reference voltage source according to the invention makes it is possible to ensure that a 1 K deviation in the temperature of one of the transistors used affects the difference between the summed voltages by only 1.3%. Furthermore, it is possible to configure the transistors crossed over in the layout of the reference voltage source according to the invention, in such a way that linear temperature gradients from any direction cannot corrupt the output voltage of the reference voltage source.

According to a preferred exemplary embodiment, circuit measures are used which compensate for the persistent parabolic temperature dependency of the reference voltage produced. Therefore, in the ideal situation, the reference voltage which is output can be produced in such a way that it is temperature-stable within a 0.03% window.

Other features which are considered as characteristic for the invention are set forth in the appended claims.

Although the invention is illustrated and described herein as embodied in a circuit for producing a reference voltage, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 2:
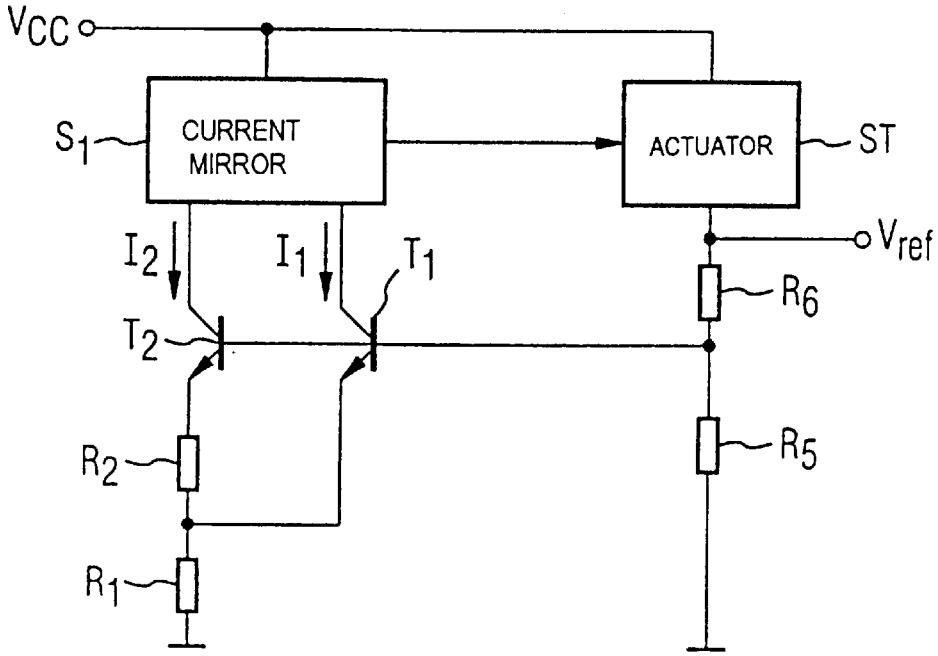
FIG 2 PRIOR ART
FIG. 2 is a simplified circuit diagram of a known reference voltage source.

Referring now to the figures of the drawings in detail and first, particularly, to FIG. 2 thereof, there is seen a generalized circuit diagram of a known bandgap reference voltage source. A current-mirror circuit S1, which is connected to a positive supply voltage connection $V_{cc}$, compares collector currents $I_1$ and $I_2$ from two npn bipolar transistors $T_1$ and $T_2$ that are connected as shown in FIG. 2. Current strengths of these currents $I_1$ and $I_2$ are governed by the transistors $T_1$ and $T_2$. Base connections of these transistors $T_1$ and $T_2$ are connected together and a base voltage of the transistor $T_1$ is multiplied by a voltage divider including two resistors $R_5$ and $R_6$. In this way, a desired output or reference voltage $V_{ref}$ can be tapped off at the resistor $R_6$. As is shown in FIG. 2, the current mirror $S_1$ has an output which supplies the result of the comparison of the currents $I_1$ and $I_2$ and which is coupled to an actuator ST, for example an operational amplifier or an amplification transistor.

A control loop shown in FIG. 2, having the current mirror $S_1$ and the actuator ST, is used to set a ratio of the respective currents $I_1$ and $I_2$ flowing through the respective transistors $T_1$ and $T_2$, wherein the currents $I_1$ and $I_2$ are usually of equal magnitude. In BICMOS circuits, however, the current $I_1$ is frequently also set to a multiple of the current $I_2$, so that the following is generally true:

$$I_1=m\cdot I_2.$$

The transistors $T_1$ and $T_2$ have different emitter areas. The emitter area of the transistor $T_2$ is equivalent to a multiple of the emitter area of the transistor $T_1$, so that a relationship between emitter areas $A_{E1}$ and $A_{E2}$ of the transistors $T_1$ and $T_2$ can be represented as follows:

$$A_{E2}=n\cdot A_{E1}.$$

Due to the relationships indicated above, emitter current densities of the transistors $T_1$ and $T_2$ differ by a factor n·m, i.e. the emitter current density of the transistor $T_1$ is (n·m) times as high as the emitter current density of the transistor $T_2$.

The summed voltage including the base/emitter voltage of the transistor $T_1$ and a voltage produced at a node between resistors $R_1$ and $R_2$ is tapped off at the common base connection of the transistors $T_1$ and $T_2$. The first-mentioned base/emitter voltage of the transistor $T_1$ corresponds to the forward voltage across a pn junction which has current flowing through it, and therefore has a negative temperature coefficient, as explained above. The voltage drop across the resistor $R_1$ depends on the difference between the base/emitter voltage of the transistor $T_1$ and the base/emitter voltage of the transistor $T_2$, and has a positive temperature coefficient, as was also explained above. The emitter/base voltage of the bipolar transistor $T_1$ falls as a function of temperature, at a rate of 2 mV/K. Appropriately selecting the resistors $R_1$ and $R_2$ and the factor n indicated above permits the bandgap reference voltage source shown in FIG. 2 to be dimensioned in such a way that the difference voltage, appearing across the resistor $R_1$, obtained from the forward voltages of the two transistors $T_1$ and $T_2$ is subject to a positive temperature coefficient of +2 mV/K, which compensates for the negative temperature coefficient. At room temperature, the voltage drop across the resistor $R_1$ is thus 2 mV/K×300 K=600 mV, so that the desired temperature-stabilized bandgap reference voltage of approximately 1.25 V (=650 mV+600 mV) is produced at the common base connection of the transistors $T_1$ and $T_2$ due to the typical emitter/base voltage of approximately 650 mV. That bandgap reference voltage is subsequently multiplied by the divider having the resistors $R_5$ and $R_6$.

The resistor ratios $R_5$:$R_6$ and $R_1$:$R_2$, the current-mirror transmission ratio $I_1$:$I_2$ (m:1) and the ratio of the emitter areas of the transistors $T_1$ and $T_2$ (1:n) are particularly critical for achieving a tight tolerance for the output voltage $V_{ref}$. Furthermore, the circuit shown in FIG. 2 reacts very sensitively to the temperature gradients widely encountered in integrated power circuits. The difference between the emitter/base voltages of the two transistors $T_1$ and $T_2$ is approximately 50 mV with customary emitter area ratios (e.g. n=8) and at customary room temperatures. If the temperatures of the transistors $T_1$ and $T_2$ differ by 1 K, the difference between the emitter/base voltages changes by approximately 2 mV, i.e. by about 4%. It is therefore necessary to configure the transistors $T_1$ and $T_2$ in an implemented circuit layout exactly on isotherms from the greatest heat source in the appropriate circuit. However, a modern layout with reusable circuit and layout blocks prevents the circuit from being adapted to suit the particular position of the available heat sources. In addition, the number of heat sources in smart power ICs is constantly increasing, so that the course of the corresponding isotherms from such heat sources cannot be determined clearly. Furthermore, the multiplicity of components having pairing properties which are critical in the bandgap reference voltage source generally necessitates individual adjustment of the circuit, which can be done, for example, using so-called "zapping" zener diodes. Such zener diodes break down and produce a low-resistance connection when a high external voltage is applied in the reverse direction. However, that increases the technical complexity.

Figure 1:
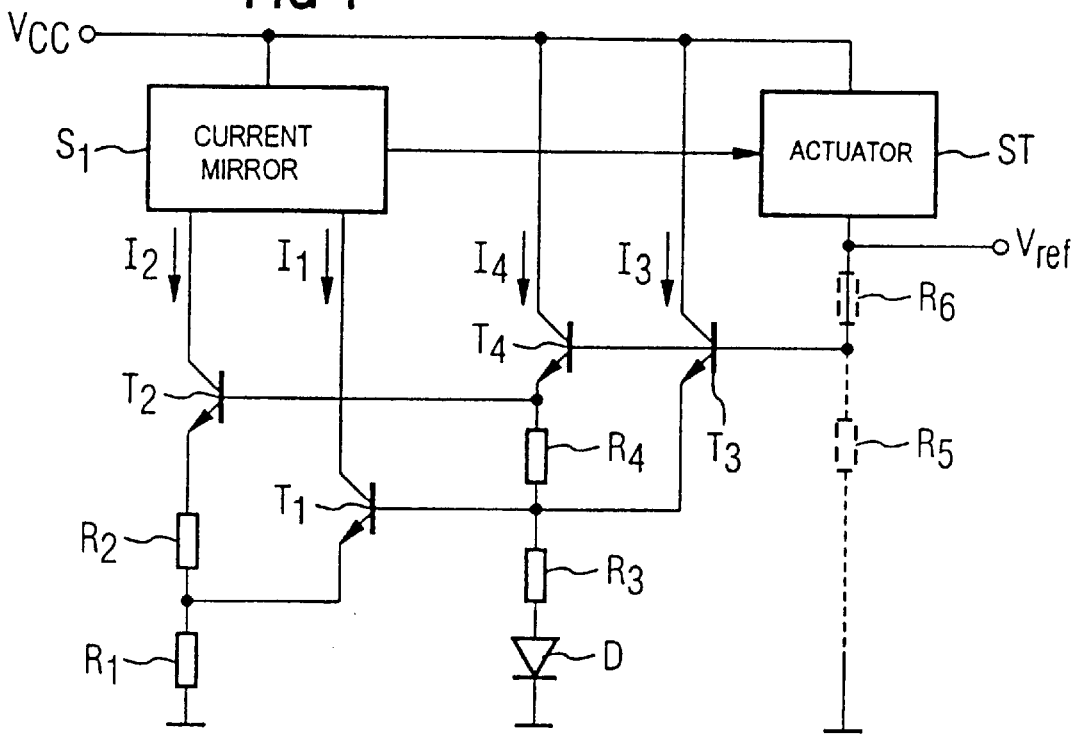
FIG. 1 is a simplified schematic circuit diagram of a preferred exemplary embodiment of a reference voltage source according to the invention.

In a simplified circuit shown in FIG. 1, which is equivalent to a preferred exemplary embodiment of a reference voltage source according to the present invention, the inherently known principle described above is again used to produce the reference voltage by adding a component with a negative temperature coefficient and a component with a positive temperature coefficient. Suitable circuit dimensioning makes it possible for the positive temperature coefficient to compensate for the negative temperature coefficient. However, according to the exemplary embodiment shown in FIG. 1, the difference between two summed voltages including a number of forward voltages across pn junctions with different current densities flowing through them is used as that component of the reference voltage being produced which is subject to a positive temperature coefficient. Furthermore, the component which has the negative temperature coefficient includes the sum of forward voltages across a number of pn junctions.

The circuit shown in FIG. 1 again includes npn transistors T1 and T2, having emitter areas $A_{E1}$ and $A_{E2}$ which are in a ratio 1:$n_1$. The transistors $T_1$ and $T_2$ are operated by respective collector currents $I_1$ and $I_2$ which are compared by a current-mirror circuit $S_1$. The current levels of these currents $I_1$ and $I_2$ are governed by the transistors $T_1$ and $T_2$. The currents $I_1$ and $I_2$ are in a ratio $m_1=I_1/I_2$ to one another. The base connections of the transistors $T_1$ and $T_2$ are isolated from one another and are respectively connected to the emitters of further npn bipolar transistors $T_3$ and $T_4$. The emitter areas $A_{E3}$ and $A_{E4}$ of the respective transistors $T_3$ and $T_4$ are in a ratio 1:$n_2$ to one another. The transistors $T_3$ and $T_4$ have different currents $I_3$ and $I_4$ flowing through them which can be varied through the use of resistors $R_3$ and $R_4$. The collectors of the transistors $T_3$ and $T_4$ are connected to a positive supply voltage potential $V_{cc}$, as shown in FIG. 1. The base connections of the transistors $T_3$ and $T_4$ are connected together. In addition, resistors $R_1$ and $R_2$ are respectively connected to the transistors $T_1$ and $T_2$ as in the known reference voltage source shown in FIG. 2. The transistors $T_1$ and $T_3$ form a first circuit device and the transistors $T_1$–$T_4$ and the resistors $R_1$–$R_4$ form a second circuit device.

The resistor $R_3$ has a diode D or a corresponding pn junction connected thereto. The voltage across the resistor $R_4$ corresponds to the difference between the emitter/base voltages of the transistors $T_3$ and $T_4$. In order to ensure that the ratio of the emitter currents in these transistors is temperature-stable, the voltage across the resistor $R_3$ must also be proportional to temperature. This is achieved through the use of the diode D, since the voltage across the resistor $R_1$ rises proportionally with temperature and the forward voltages across the bipolar transistor $T_1$ and the diode D do not differ significantly. Therefore, the voltage waveform across the resistor $R_3$ is proportional to the temperature, as desired.

In the reference voltage source shown in FIG. 1, the desired reference or output voltage is tapped off at the common base connection of the bipolar transistors $T_3$ and $T_4$. This output voltage corresponds to the summed voltage including the base/emitter voltages of the transistors $T_3$ and $T_1$ and the voltage produced at the node between the resistors $R_1$ and $R_2$. The base/emitter voltages of the transistors $T_3$ and $T_1$ are known to have a negative temperature coefficient of approximately −2 mV/K. The voltage produced at the node between the resistors $R_1$ and $R_2$ is determined by the base/emitter voltages of the transistors $T_1$–$T_4$. That voltage corresponds, in particular, to the difference between a first voltage, which depends on the sum of the forward voltages across the transistors $T_1$ and $T_3$, which have a high current density flowing through them, and a second voltage, which depends on the sum of the forward voltages across the bipolar transistors $T_2$ and $T_4$, which have a low current density flowing through them. This means that the voltage produced at the node between the resistors $R_1$ and $R_2$ depends on the difference between the sum of the base/emitter voltages of the transistors $T_1$ and $T_3$ and the sum of the base/emitter voltages of the transistors $T_2$ and $T_4$. Suitably dimensioning the components shown in FIG. 1 and the currents supplied to the individual bipolar transistors makes it possible for the difference voltage produced at the node between the resistors $R_1$ and $R_2$ to have a positive temperature coefficient. That positive temperature coefficient is such that it compensates for the negative temperature coefficient of the base/emitter voltages of the bipolar transistors $T_3$ and $T_1$. In this case, the positive temperature coefficient of the difference voltage drop across the resistor $R_1$ must be as high as the negative temperature coefficient of the base/emitter voltages of the transistors $T_3$ and $T_1$, and consequently must be approximately +4 mV/K. This means that, at room temperature (300 K), a voltage drop of approximately 1.2 V must be produced across the resistor $R_1$, so that the output voltage finally tapped off at the common base connection of the bipolar transistors $T_3$ and $T_4$ is roughly 2.5 V (=1.2 V+2×650 mV). That is twice as high as in the known reference voltage source shown in FIG. 2. Therefore, the reference voltage source shown in FIG. 1 is, in principle, a double bandgap reference voltage source.

The voltage of approximately 2.5 V produced at the common base of the transistors $T_3$ and $T_4$ is sufficiently high for most applications, so that the use of a voltage divider with resistors $R_5$ and $R_6$ for multiplying the reference voltage can, in principle, be dispensed with. Therefore, in the circuit shown in FIG. 1, the voltage divider with the resistors $R_5$ and $R_6$ is only shown in broken lines.

Of course, it is a simple matter to modify the circuit shown in FIG. 1 in such a way that not only is the difference between two summed voltages formed but rather, by using a correspondingly larger number of bipolar transistors, the difference between a number of summed voltages is formed. Each of these summed voltages corresponds to the addition of even three or more forward voltages across pn junctions which have different current densities flowing through them. In this way, it is possible to modify the circuit shown in FIG. 1 in such a way that a voltage is generally tapped off at bas base connection of the transistor $T_3$. That voltage is equivalent to a multiple of the bandgap of silicon.

With regard to the circuit shown in FIG. 1, it should be noted that the emitter current of the bipolar transistor $T_4$ can be chosen to be very small. That is because the largest thermal leakage current, in junction-isolated bipolar technologies, from the collector of each npn transistor to the substrate, does not affect the emitter current of the corresponding npn transistor in the present case. If, for example, the emitter currents of the bipolar transistors $T_3$ and $T_4$ are 10 $\mu$A and 0.5 $\mu$A (ratio: 1:20), respectively, the emitter area ratios $n_1$ and $n_2$ are each 4 and the collector currents $I_1$, $I_2$ in the bipolar transistors $T_1$, $T_2$ are the same size (i.e. $m_1$=1). The difference voltage (explained above) formed by the sums of the individual forward voltages is approximately 150 mV. A 1 K deviation in the temperature of one of the bipolar transistors $T_1$–$T_4$ now has merely a 1.3% effect on this difference voltage, so that the reference voltage circuit shown in FIG. 1 is less sensitive to temperature fluctuations or temperature gradients. In addition, it is easier to configure the transistors shown in FIG. 1 as being crossed over in the layout of the circuit that is actually produced, in such a way that linear temperature gradients from any direction cannot corrupt the output voltage at the common base connection of the bipolar transistors $T_3$ and $T_4$.

Through skillful selection of the individual components shown in FIG. 1, the resistor ratio $R_1$:$R_2$ can be fixed at 4:1. This is a ratio which can be set particularly precisely. The current mirror $S_1$ can be produced particularly accurately if the current ratio $I_1$:$I_2$ is 1:1, i.e. $m_1$=1.

As in the case of the known reference voltage source shown in FIG. 2, the circuit shown in FIG. 1 also has an actuator ST which is again connected to the output connection of the current mirror $S_1$ and is driven in dependence on the result of the comparison in the current mirror S1. This makes it possible to readjust the output voltage $V_{ref}$ if this output connection is unevenly loaded.

The general principle on which the present invention is based has been explained with reference to FIG. 1. In contrast, FIG. 3 shows a refined exemplary embodiment of the reference voltage source according to the invention, in which corresponding components are provided with the same reference symbols and the description of these components is not repeated.

Figure 3:
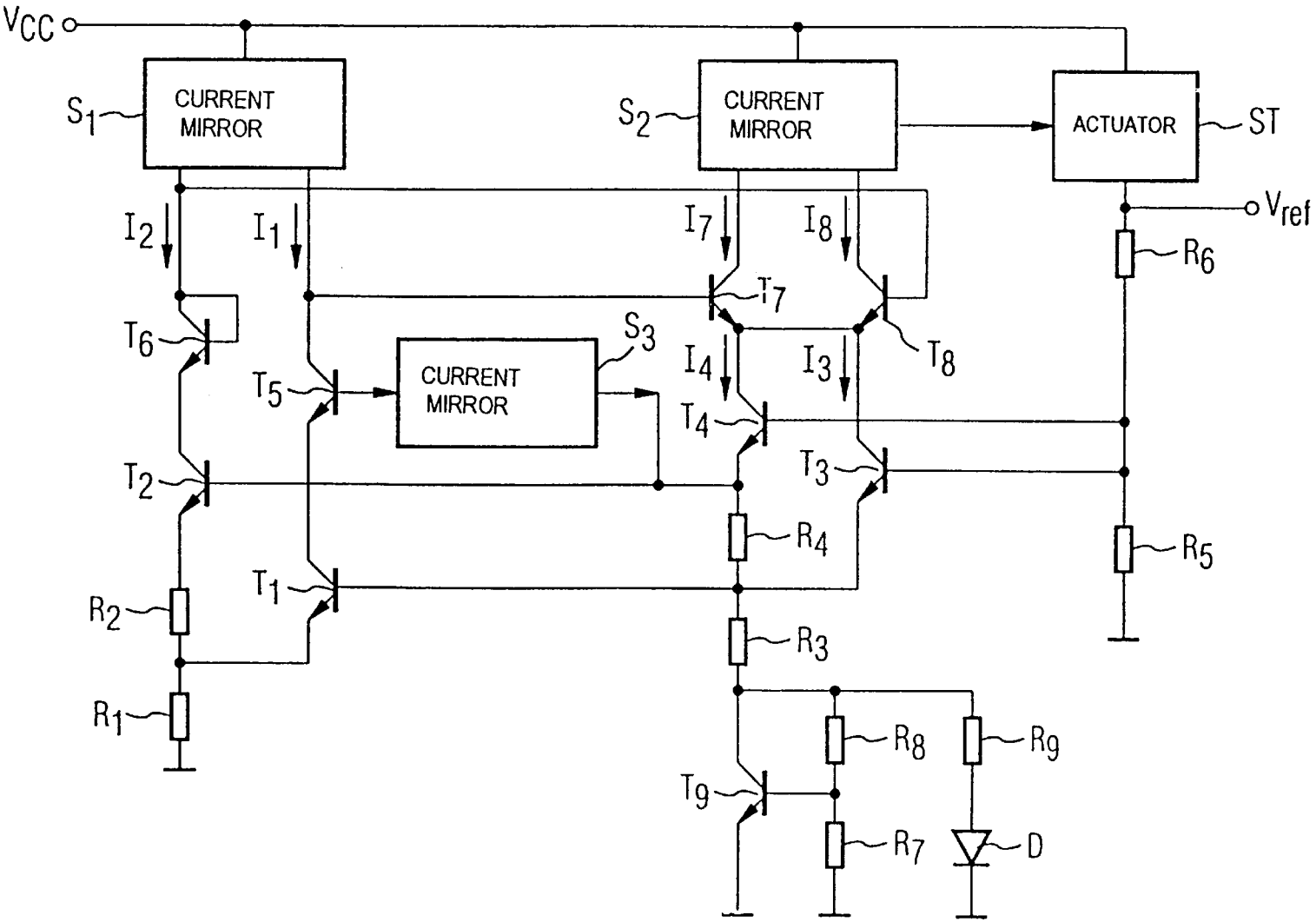
FIG. 3 is a circuit diagram of a refined exemplary embodiment of the reference voltage source according to the invention.

As is shown in FIG. 3, a further current-mirror circuit $S_2$ is used which compares respective collector currents $I_7$ and $I_8$ from further transistors $T_7$ and $T_8$, and drives the actuator ST, depending on the result of the comparison. These bipolar transistors $T_7$ and $T_8$ form an amplifier stage in order to keep the current consumption of the reference voltage source shown in FIG. 3 as low as possible. In the current mirror $S_1$, the inputs correspond to the outputs and are connected to the base connections of the transistors $T_7$ and $T_8$. A further npn bipolar transistor $T_5$ is used, together with another current-mirror circuit $S_3$, for compensating for errors produced by the base current of the transistor $T_2$. An npn bipolar transistor $T_6$ shown in FIG. 3 is used to permit the thermal leakage currents from the collectors of the bipolar transistors $T_1$ and $T_5$ to the substrate and the thermal leakage currents in the bipolar transistors $T_2$ and $T_6$ to cancel one another out if the translation ratio of the current mirror $S_1$ is 1:1. The bipolar transistor $T_5$ has an emitter area which is equivalent to the emitter area of the bipolar transistor $T_2$, while the bipolar transistor $T_6$ has an emitter area which is equivalent to the emitter area of the bipolar transistor $T_1$. In other words, the emitter area of the bipolar transistor $T_5$ is $n_1$ times as large as the emitter area of the bipolar transistor $T_6$.

The resistor $R_3$ is coupled to a circuit configuration which, in addition to the diode D already illustrated in FIG. 1, has resistors $R_7$–$R_9$ that are connected as shown in FIG. 3, as well as a further bipolar transistor $T_9$. Elements D, $T_9$ and $R_7$–$R_9$ may also be referred to as a third circuit device.

This circuit configuration works as follows: At low temperatures, the flow of current through the resistor $R_3$ is at its lowest and the forward voltages across all of the pn junctions are so high that the resistors $R_7$ and $R_8$ essentially determine the behavior of this circuit configuration. At medium temperatures, the path running through the diode D and the resistor $R_9$ is dominant. The resistor in the equivalent circuit diagram for this circuit configuration is smaller in this case due to the resistors $R_8$ and $R_7$ being connected in parallel with the resistor $R_9$, and the diode voltage being divided by a factor $(R_8+R_7)/(R_7+R_8+R_9)$. In contrast, at high temperatures, the path running through the transistor $T_9$ is dominant. The equivalent circuit diagram has a diode forward voltage increased by a factor $(R_7+R_8)/R_7$ without a series resistor. This produces a temperature response at the collector of the bipolar transistor $T_9$ which is linear in sections and has the approximate profile of a parabolic function. Therefore, when this circuit configuration is dimensioned correctly, it is possible to compensate for the parabolic temperature dependency of the reference voltage, which persists in spite of the temperature stabilization produced by forming the difference voltage. In the ideal situation, the reference voltage which is obtained can thus be produced so that it is temperature-stable within a 0.03% window. Finally, FIG. 3 additionally shows a voltage divider with resistors $R_5$ and $R_6$, which is connected to the common base connection of the transistors $T_3$ and $T_4$, in order to multiply the base voltage of these transistors and obtain the desired reference voltage $V_{ref}$.

Figure 4:
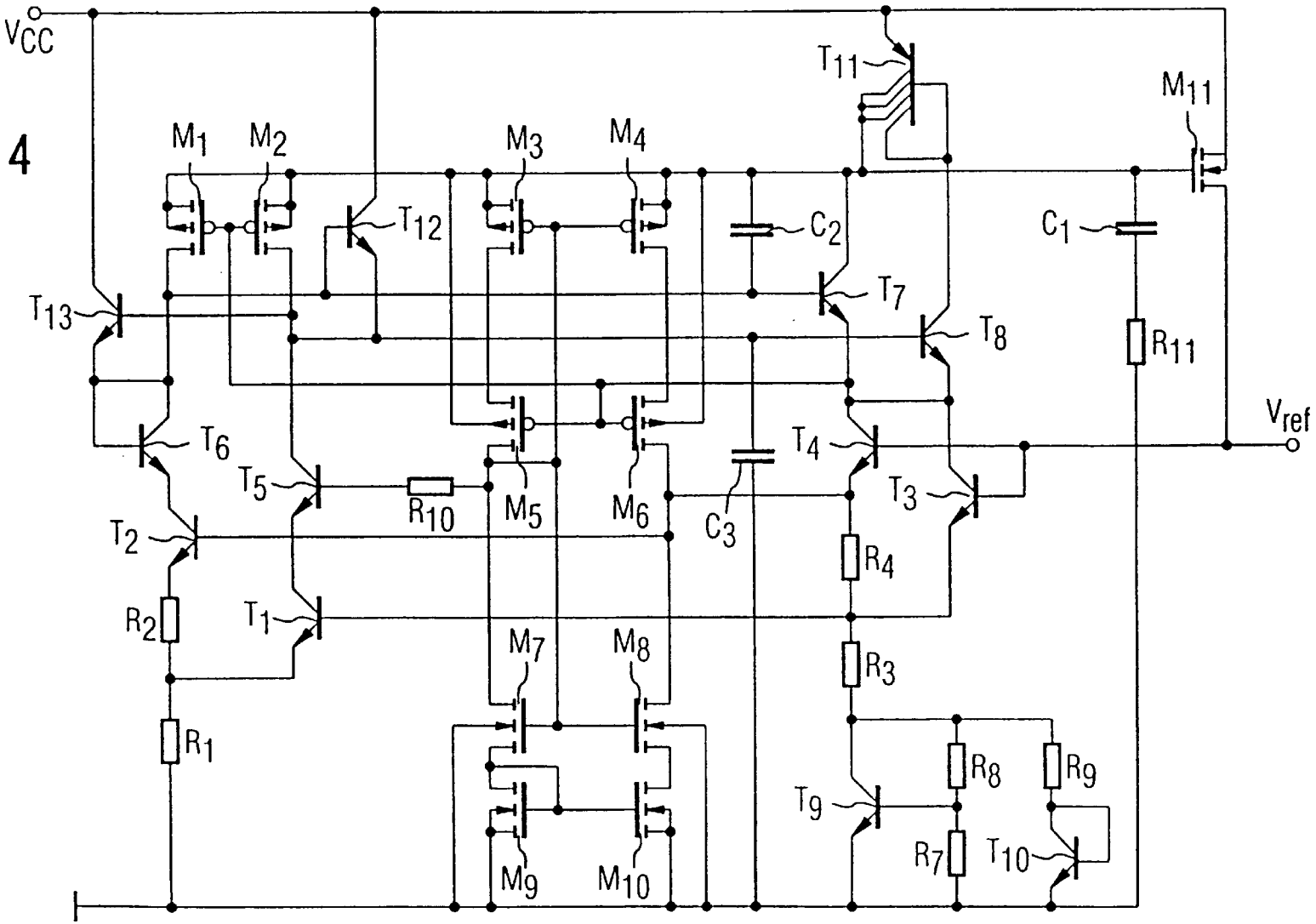
FIG. 4 is a circuit diagram of an embodiment of the reference voltage source of the present invention as shown in FIG. 3, which has been refined further and has actually been produced.

FIG. 4 shows an example of a double bandgap reference voltage source according to the present invention, which is produced on a test chip. In this figure, those components corresponding to the components shown in FIG. 3 are again provided with the same reference symbols and are not explained again.

As is shown in FIG. 4, two p-channel MOS field effect transistors $M_1$ and $M_2$ form the current mirror $S_1$ shown in FIG. 3. These transistors $M_1$ and $M_2$ have a common gate connection being connected to the common emitter connection of the transistors $T_7$ and $T_8$. The other current mirror $S_3$ shown in FIG. 3 includes p-channel MOS field effect transistors $M_3$–$M_6$ and n-channel MOS field effect transistors $M_7$–$M_{10}$. In contrast, the current-mirror circuit $S_2$ is a pnp bipolar transistor $T_{11}$. As is shown in FIG. 4, the reference-ground potential of the current mirrors $S_1$ and $S_3$ corresponds to the input potential of the actuator ST, which is a control transistor $M_{11}$. Furthermore, the reference-ground potential of the current mirror $S_2$ is connected to the reference-ground potential of the control transistor $M_{11}$.

However, the above-described connection between the reference-ground potentials is not absolutely necessary.

A resistor $R_{10}$ which is additionally shown in FIG. 4 is used to compensate for the thermal leakage current in the resistor $R_4$. Transistors $T_{12}$, $T_{13}$, capacitors $C_1$–$C_3$ and a resistor $R_{11}$ are components which are used to stabilize the circuit.

Finally, the diode D shown in FIG. 3 is the pn junction of a further bipolar transistor $T_{10}$, having a base/collector path which is short-circuited. Otherwise, the operation of the reference voltage source shown in FIG. 4 corresponds to that of the circuits shown in FIGS. 1 and 3.

I claim:

1. A circuit for producing a reference voltage, comprising:

a first circuit device for producing a first voltage having a negative temperature coefficient;

a second circuit device for producing a difference voltage from a second voltage and a third voltage;

the second voltage and the third voltage each derived from forward voltages across corresponding pn junctions and the difference voltage subject to a positive temperature coefficient;

the first voltage from said first circuit device and the difference voltage from said second circuit device added together to form a reference voltage to be tapped off;

said first circuit device deriving the first voltage from a summed voltage formed by at least two forward voltages across corresponding pn junctions; and said second circuit device deriving the second voltage and the third voltage from respective first and second summed voltages each formed by at least two forward voltages across corresponding pn junctions, and said second circuit device producing the difference voltage from the second and third voltages.

2. The circuit for producing a reference voltage according to claim 1, wherein said second circuit device derives the second voltage and the third voltage from respective first and second summed voltages each formed by at least two forward voltages across corresponding pn junctions having different current densities flowing through them.

3. The circuit for producing a reference voltage according to claim 1, wherein said second circuit device includes first, second, third, and fourth bipolar transistors having respective first, second, third and fourth current densities flowing through them, the second voltage is derived from the summed voltage formed by the forward voltages across said first and said third bipolar transistors, and the third voltage is derived from the summed voltage formed by the forward voltages across said second and said fourth bipolar transistors, said first and said third bipolar transistors have a higher current density flowing through them than said second and said fourth bipolar transistors, and said first and said third bipolar transistors are both constituent parts of said first circuit device deriving the first voltage from the summed voltage formed by the forward voltages across said first and said third bipolar transistors.

4. The circuit for producing a reference voltage according to claim 3, wherein said first, second, third, and fourth bipolar transistors have emitter areas, the emitter area of said second bipolar transistor is equivalent to a multiple of the emitter area of said first bipolar transistor, and the emitter area of said fourth bipolar transistor is equivalent to a multiple of the emitter area of said third bipolar transistor.

5. The circuit for producing a reference voltage according to claim 4, including:

first, second, third, and fourth resistors;

said first, second, third, and fourth bipolar transistors having collectors, bases and emitters;

the collector of said first bipolar transistor supplied with a first current, the collector of said second bipolar transistor supplied with a second current, the collector of said third bipolar transistor supplied with a third current and the collector of said fourth bipolar transistor supplied with a fourth current;

the base of said first bipolar transistor connected to the emitter of said third bipolar transistor with a first node therebetween, and the emitter of said first bipolar transistor connected through said first resistor to a negative supply voltage connection and through said second resistor to the emitter of said second bipolar transistor;

the base of said second bipolar transistor connected to the emitter of said fourth bipolar transistor with a second node therebetween, said first node connected through said third resistor to the negative supply voltage connection and through said fourth resistor to said second node; and the base of said third bipolar transistor connected to the base of said fourth bipolar transistor, causing a summed voltage including base/emitter voltages of said third bipolar transistor and of said first bipolar transistor to correspond to the first voltage, causing a voltage drop across said first resistor to correspond to the difference voltage, and permitting the reference voltage to be tapped off at the base of said third bipolar transistor.

6. The circuit for producing a reference voltage according to claim 5, wherein the emitter area of said second bipolar transistor is approximately four times as large as the emitter area of said first bipolar transistor, the emitter area of said fourth bipolar transistor is approximately four times as large as the emitter area of said third bipolar transistor, the first current supplied to said first bipolar transistor is approximately the same size as the second current supplied to said second bipolar transistor, and said first resistor is approximately four times as large as said second resistor.

7. The circuit for producing a reference voltage according to claim 5, wherein the third and the fourth currents respectively supplied to said third and said fourth bipolar transistors and said third and said fourth resistors together cause an emitter current in said fourth bipolar transistor to be markedly smaller than an emitter current in said third bipolar transistor.

8. The circuit for producing a reference voltage according to claim 5, including a current-mirror circuit connected to a positive supply voltage connection and providing the first current supplied to said first bipolar transistor and the second current supplied to said second bipolar transistor.

9. The circuit for producing a reference voltage according to claim 8, wherein said current-mirror circuit is one current-mirror circuit, a fifth bipolar transistor is connected between said one current-mirror circuit and the collector of said first bipolar transistor, said fifth bipolar transistor has a base, and another current-mirror circuit is connected between the base of said fifth bipolar transistor and said second node.

10. The circuit for producing a reference voltage according to claim 9, including a sixth bipolar transistor with a short-circuited base/collector path, said sixth bipolar transistor connected between said one current-mirror circuit and the collector of said second bipolar transistor.

11. The circuit for producing a reference voltage according to claim 10, wherein said fifth and sixth bipolar transistors have emitter areas, the emitter area of said sixth bipolar transistor is approximately equivalent to the emitter area of said first bipolar transistor, the emitter area of said fifth bipolar transistor is approximately equivalent to the emitter area of said second bipolar transistor, and said one current-mirror circuit has a translation ratio of 1:1.

12. The circuit for producing a reference voltage according to claim 9, including a further current-mirror circuit connected to a positive supply voltage connection and providing the third current supplied to said third bipolar transistor and the fourth current supplied to said fourth bipolar transistor, and an amplifier circuit connected between said further current-mirror circuit and the collectors of said respective third and said fourth bipolar transistors.

13. The circuit for producing a reference voltage according to claim 5, including a third circuit device for compensating for a parabolic temperature dependency of the reference voltage produced by said second circuit device.

14. The circuit for producing a reference voltage according to claim 13, wherein said third circuit device includes a diode connected between said third resistor and the negative supply voltage connection.

15. The circuit for producing a reference voltage according to claim 14, wherein said third circuit device includes:

a parallel circuit connected between said third resistor and the negative supply voltage connection, said parallel circuit including a series circuit having another resistor and said diode and a series circuit having two further resistors with a node therebetween; and a further bipolar transistor having a main current path connected in parallel with said two further resistors and a base connected to said node between said two further resistors.

16. The circuit for producing a reference voltage according to claim 5, wherein said first circuit device includes an amplifier device for amplifying the reference voltage.

17. The circuit for producing a reference voltage according to claim 16, wherein said amplifier device include a voltage divider acting on the base of said third bipolar transistor.

18. The circuit for producing a reference voltage according to claim 1, wherein said first and said second circuit devices cause the reference voltage produced as the sum of the first voltage from said first circuit device and the difference voltage from said second circuit device to be approximately 2.5 V.

19. The circuit for producing a reference voltage according to claim 1, including a control device for maintaining constancy of the reference voltage output to an output connection by the circuit for producing a reference voltage, when the output voltage connection is unevenly loaded.

* * * * *